US007738671B2

(12) United States Patent
Ito et al.

(10) Patent No.: US 7,738,671 B2
(45) Date of Patent: Jun. 15, 2010

(54) HEADPHONE

(75) Inventors: Tomohiro Ito, Kanagawa (JP); Rumi Nakano, Tokyo (JP); Tomomi Hamada, Tokyo (JP)

(73) Assignee: Sony Corporation, Tokyo (JP)

( * ) Notice: Subject to any disclaimer, the term of this patent is extended or adjusted under 35 U.S.C. 154(b) by 2 days.

(21) Appl. No.: 12/070,624

(22) Filed: Feb. 20, 2008

(65) Prior Publication Data

US 2008/0159581 A1 Jul. 3, 2008

Related U.S. Application Data

(62) Division of application No. 10/527,939, filed as application No. PCT/JP03/11916 on Sep. 18, 2003.

(30) Foreign Application Priority Data

Sep. 18, 2002 (JP) ..... 2002-272142

(51) Int. Cl.
*H04R 25/00* (2006.01)

(52) U.S. Cl. ..... 381/370; 381/374; 381/381

(58) Field of Classification Search ..... 381/309, 381/327, 328, 330, 370, 374, 376–381, 385, 381/384; 351/123, 141, 158, 111; 2/209, 2/906; 181/129, 130, 135; 455/349–351, 455/575.6; 379/430

See application file for complete search history.

(56) References Cited

U.S. PATENT DOCUMENTS

| | | | | |
|---|---|---|---|---|
| 5,715,323 | A * | 2/1998 | Walker | 381/385 |
| 6,233,345 | B1 * | 5/2001 | Urwyler | 381/381 |
| 6,868,164 | B2 | 3/2005 | Ito et al. | |
| 2006/0126881 | A1 * | 6/2006 | Ito et al. | 381/374 |

FOREIGN PATENT DOCUMENTS

| | | |
|---|---|---|
| JP | 63-191795 | 12/1988 |
| JP | 09247782 | 9/1997 |
| JP | 10-150693 | 6/1998 |
| JP | 2001-95078 | 4/2001 |

* cited by examiner

*Primary Examiner*—Huyen D Le
(74) *Attorney, Agent, or Firm*—Frommer Lawrence & Haug LLP; William S. Frommer; Paul A. Levy

(57) ABSTRACT

The present invention aims to provide headphones having no headband in which left and right driver units are connected by a cord passed behind the neck, wherein the headphones will not slip off if hung on the shoulders when not being used and are intended to improve fashionableness; in headphones 10 having no headband in which left and right driver units 2L, 2R are connected by a cord 4 passed behind the neck, the middle part of this cord is inserted into a cylindrical belt 11*a*, and also end members 12, 12 which fix the cord 4 and this cylindrical belt 11*a* are provided at both ends of this cylindrical belt 11*a* to form a belt-like strap portion 11; and further this cylindrical belt 11*a* is provided with a print or decoration which is pliable and flexible when being bent, for example.

4 Claims, 8 Drawing Sheets

HEADPHONE

This application is a divisional of co-pending application Ser. No. 10/527,939, filed Dec. 27, 2005, under 35 U.S.C. 371 from International Application PCT/JP03/11916, filed Sep. 18, 2003 with a claim of priority under 35 U.S.C. 119 to Japanese Patent Application No. 2002-272142 filed in Japan on Sep. 18, 2002, the entirety thereof being incorporated herein by reference.

BACKGROUND OF THE INVENTION

1. Field of the Invention

The present invention relates to what is called neck chain type headphones having no headband, in which left and right driver units are connected by a cord passed behind a neck.

2. Description of Related Art

In recent years, as the age of individualization progresses especially amongst youngsters, outdoor fashion oriented things have been in great demand. With this trend, headphones of an ear-hook attachment type having no headband and the like are widely accepted by those who care about their hairstyles and fashions.

Headphones of what is called a neck chain type worn with a cord passed behind a neck, which have been obtained by improving conventional Y-shaped headphones with cords branching in front of the user's chest, are headphones of a convenient method recognized widely, in which when being used, the headphones can be detached and then hung on the shoulders such as hanging down from the neck, and which have been used as a part of clothing by a wearer who does not wear headphones but hangs them on his/her neck or shoulders instead, while walking in town.

An example of such conventional ear-hook headphones of a neck chain type having no headband is shown in FIG. 11. In headphones 1 of the conventional neck chain type, a bridge cord 4 passes from a right unit 2R to a left unit 2L and is connected to a plug-attached cord 5, and this plug-attached cord 5 is connected directly or through, for example, a remote control section not shown in the figure to a destination jack of a portable audio apparatus or the like. Numerals 3, 3 are ear-hook portions which are hooked on the left and right auricles, respectively.

FIG. 12 is an external view showing an example in which the ear-hook headphones 1 of a neck chain type having no headband are worn. When worn on respective ears of a user 6, the left and right units 2L, 2R of the headphones 1 are worn with the bridge cord 4 passed behind his/her ears. FIG. 13 is a drawing in which the headphones 1 are worn and seen from a right backside. Passed behind the neck of the user 6, the bridge cord 4 is connected to the right unit 2R of the headphones 1.

FIG. 14 is a view in which a state of the headphones 1 detached from the ears and hung on the shoulders is seen from a diagonally forward leftside. When the user 6 is using the headphones 1 but not listening to music or the like, the units 2L, 2R can be hung on his/her shoulders with the bridge cord 4 serving as a strap.

FIGS. 15A and 15B show headphones of an inner ear type where the above described ear-hook headphones of a neck chain type are replaced, in which FIG. 15A shows an example of an inner ear type headphone and FIG. 15B shows a schematic view showing an example of the inner ear type headphones of a neck chain type being worn. Similarly to FIG. 12, the bridge cord 4 is passed behind the neck and left and right units 7L, 7R are inserted into the entrances of the external auditory canals of the user 6. Further, respective states in which the inner ear type headphones are worn and hung on the shoulders are similar to those of FIGS. 13 and 14.

SUMMARY OF THE DISCLOSURE

Hereupon, if the upper body of the user moves in the state in which headphones are used as described above, that is, the headphones are not worn on the ears but hung on the shoulders, the whole headphones including the bridge cord 4 can be out of position. In particular, as shown in FIG. 14, in a structure in which a plug-attached cord 5 connected to a portable audio apparatus or the like is always hanging down on the left side, there has been an inconvenience that the whole headphones 1 are liable to slip toward the left (in the arrow direction in the drawing), being pulled by the plug-attached cord 5 when, for example, a user walks in town with the headphones 1 not worn but hung on his/her shoulders.

Further, in the headphones such as ear-hook type headphones for which fashion-oriented factors are strongly required, decorative gimmick has also been requested with respect to cord portions which used to be an inconspicuous part. Furthermore, regarding headphones in the low-price range, being small in size and light in weight has been demanded, and in order to improve appearances in design, a simple and compact structure has also been demanded, however, there has been no product to satisfy such demand.

In light of the above, the present invention aims in providing headphones having no headband in which left and right driver units are connected by a cord passed behind the neck, which do not slip off when hung on the shoulders but not being used and which improve fashionableness thereof.

Headphones of the present invention, in which left and right driver units are connected by a cord passed behind the neck having no headband, include a belt-like strap portion formed in the middle part of the cord.

According to the present invention, the belt-like strap portion in the middle part of the cord functions as a slip stopper and the headphones will not slip off if hung around the neck, and further with increasing the thickness of the middle part of this cord, the area of a part which touches the neck increases, so that the weight which a user feels on his/her neck can be reduced to some extent.

Headphones of the present invention, in which left and right driver units are connected by a cord passed behind the neck having no headband, include a belt-like strap portion in which the middle part of the cord is inserted into a cylindrical belt and end members fixing the cord and cylindrical belt are provided at both ends of this cylindrical belt.

According to the present invention, since the cord and cylindrical belt are fixed by the end members, the cylindrical belt is prevented from sliding on the cord. Further, the cylindrical belt forming the strap portion in the middle part of the cord functions as a slip stopper, so that the headphones will not slip off if hung around the neck, and with increasing the thickness of the middle part of this cord, the area of a part which touches the neck increases and weight which a user feels on his/her neck can be reduced to some extent.

Headphones of the present invention, in which left and right driver units are connected by a cord passed behind the neck having no headband and a strap portion is formed in the middle part of the cord, have a structure in which additional ornaments are attached to the strap portion.

According to the present invention, since accessories and the like can be attached to the strap portion in the middle part of the bridge cord, fashionableness improves.

Headphones of the present invention, in which left and right driver units are connected by a cord passed behind the neck having no headband and a strap portion is formed in the middle part of the cord, have a print or decoration pliable and flexible when being bent made on the strap portion.

According to the present invention, providing a print or decoration on the strap portion improves fashionableness, and also making the above print and decoration pliable and flexible when being bent can prevent from occurring the cracking, detaching and the like of the printed surface and the decorated surface.

According to the present invention, the strap portion provided in the middle part of the cord, which connects the left and right driver units and is passed behind the neck, functions as a slip stopper, so that the headphone apparatus will not slip off if hung around the neck; and also increasing the thickness of the middle part of the cord increases the area of a part which touches the neck, weight which a user feels on his/her neck can be reduced to some extent, and accordingly the headphones are worn comfortably and usability can be improved.

According to the present invention, since the cord connecting the left and right driver units and passing behind the neck and the cylindrical belt are fixed by the end members, the cylindrical belt is prevented from sliding on the cord. Further, the cylindrical belt forming the strap portion in the middle part of the cord functions as a slip stopper, so that a headphone apparatus will not slip off if hung around the neck; and also with increasing the thickness of the middle part of the cord, the area of a part which touches the neck increases, weight which a user feels on his/her neck can be reduced to some extent, and accordingly the headphones are worn comfortably and usability can be improved.

According to the present invention, in the case where favorite accessories and the like is attached to the strap portion provided on the cord which connects the left and right driver units and is passed behind the neck, there is improvement in fashionableness.

According to the present invention, providing a print or decoration on the strap portion improves fashionableness, and also making the above print and decoration pliable and flexible when being bent can prevent from occurring the cracking, detaching and the like of the printed surface and the decorated surface, which enables the headphones to meet various demands for design.

DETAILED DESCRIPTION

Figure 1:
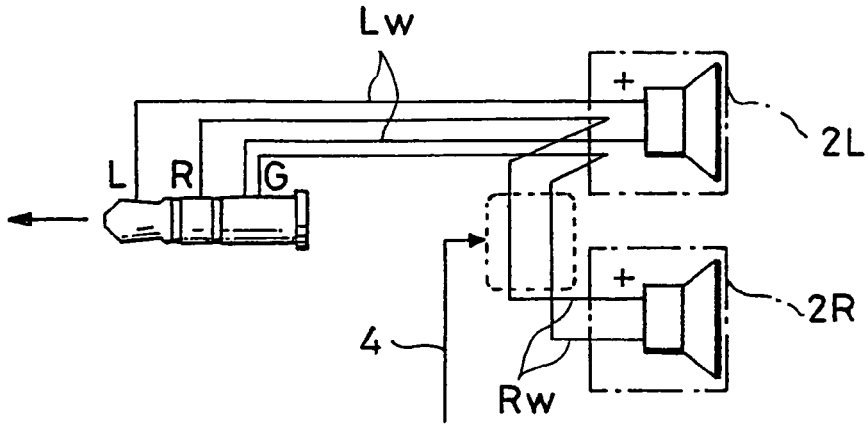
FIG. 1 is a circuit diagram of stereo headphones.

Hereinafter, embodiments of headphones of the present invention are explained referring to FIGS. 1 to 10. An example of a circuit diagram of headphones of a neck chain type is shown in FIG. 1. As a connection structure of headphones including a left unit 2L and a right unit 2R, one ends of twin-core wires of resin-coated parallel cords Lw, Rw are connected to left and right loudspeaker portions (driver units) respectively, and the other ends of the twin-core wires are connected to a left terminal L and a ground terminal G and to a right terminal R and the ground terminal G, of a plug portion, respectively. In addition, in headphones of a neck chain type, a structure in which the parallel cords Rw from the plug portion are connected to the right unit 2R through the left unit 2L as shown by the dotted line is employed.

Figure 2:
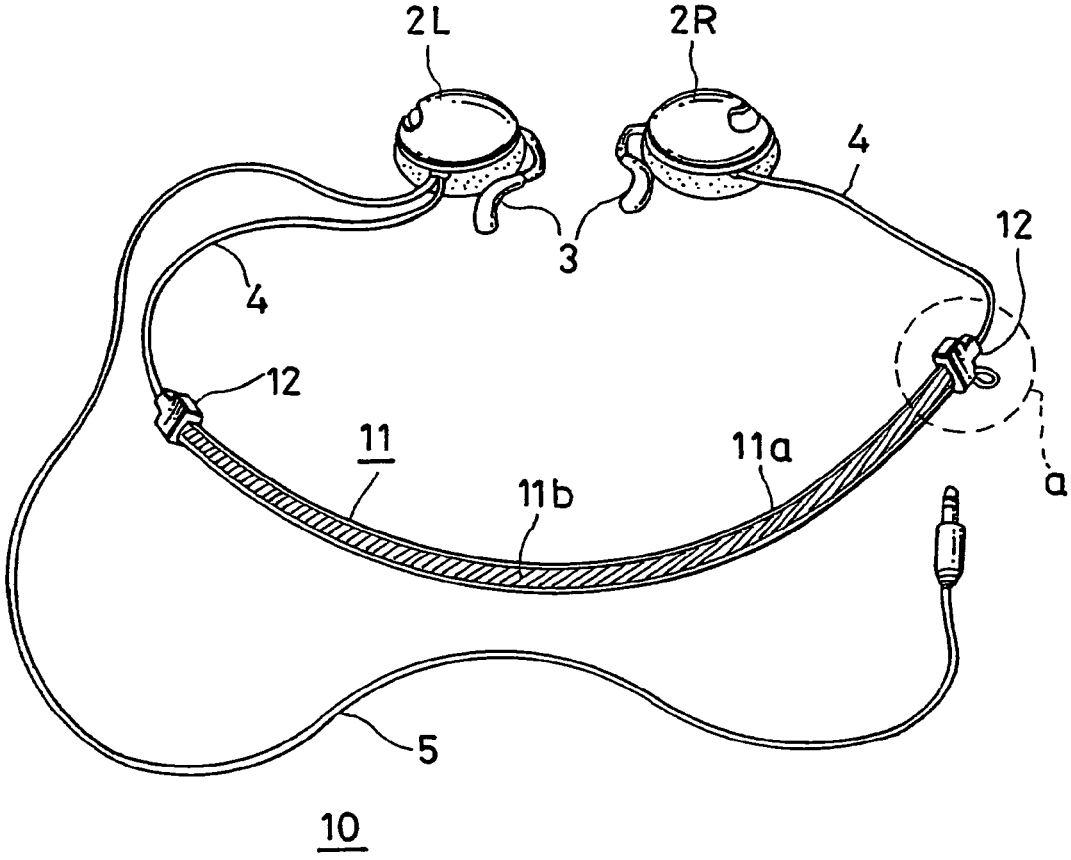
FIG. 2 is an external view of headphones of the present invention.
Figure 11:
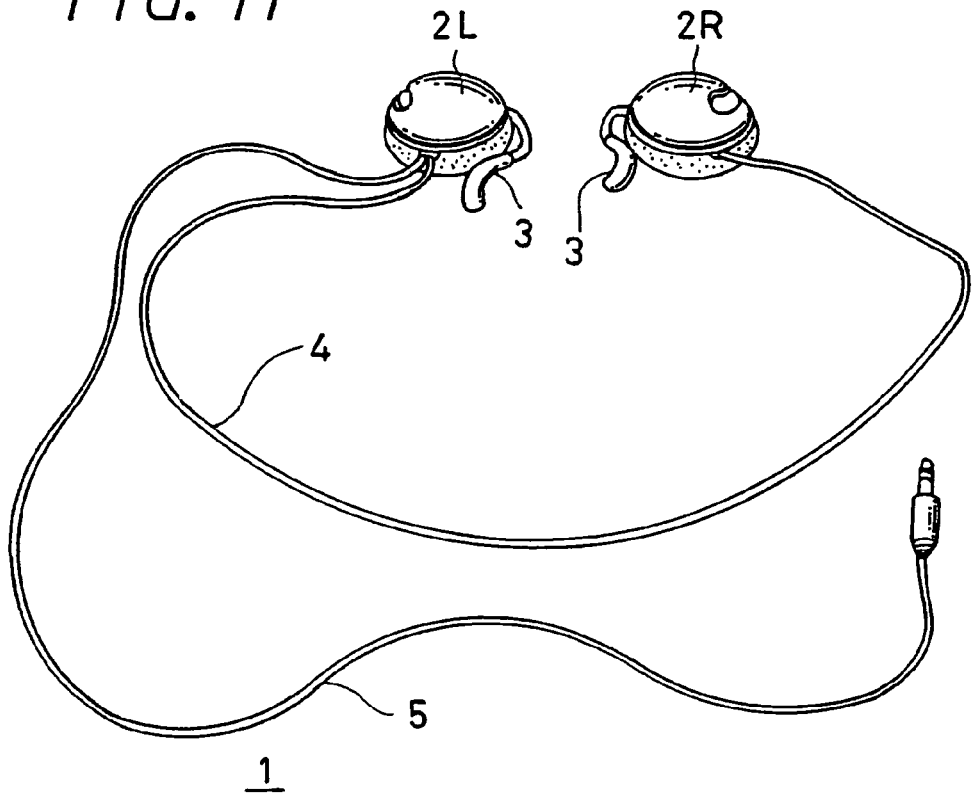
FIG. 11 is an external view showing an example of conventional ear-hook headphones of a neck chain type having no headband.
Figure 12:
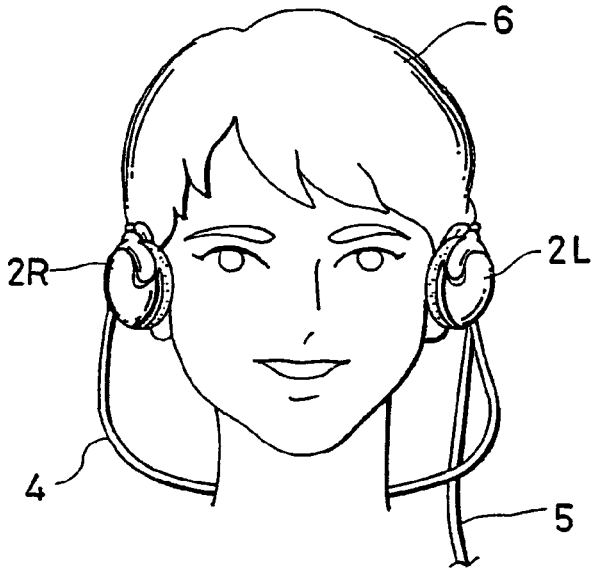
FIG. 12 is a front view showing an example in which the headphones of FIG. 11 are worn.
Figure 13:
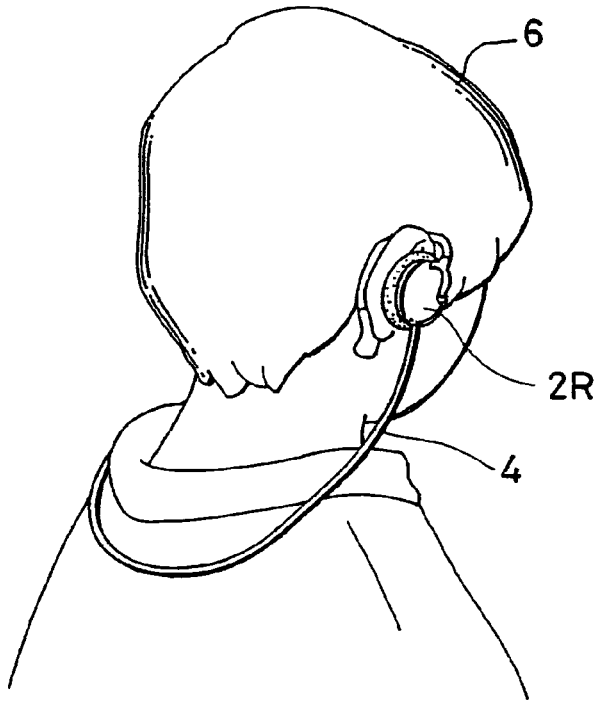
FIG. 13 is a right rear view showing an example in which the headphones of FIG. 11 are worn.
Figure 14:
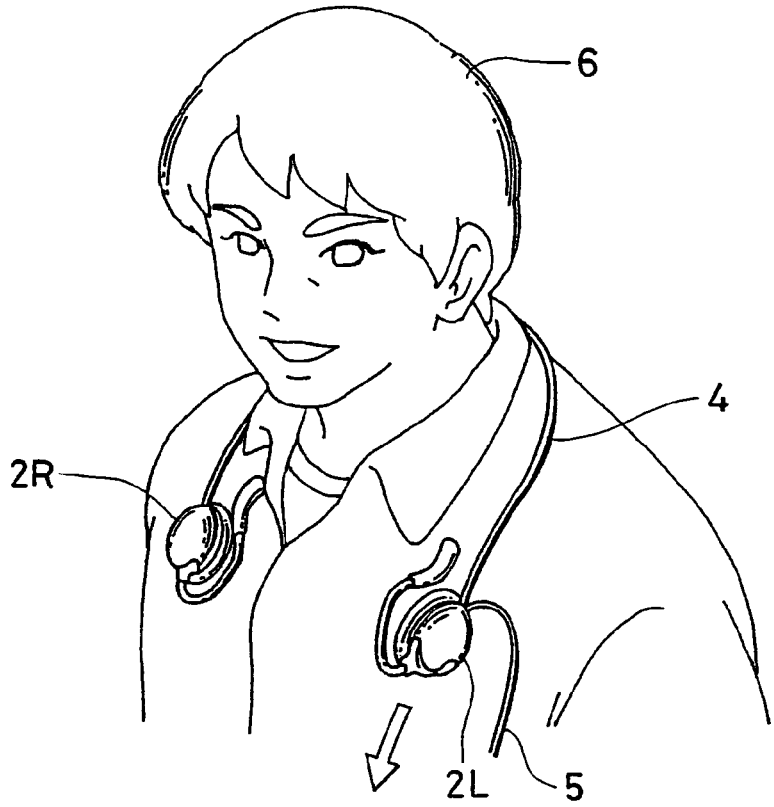
FIG. 14 is a diagonal left front view showing a state in which the headphones of FIG. 11 are hung on the shoulders.
Figure 15A:
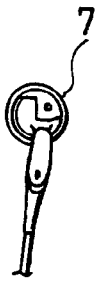
FIG. 15A is an external view of an inner ear type headphone apparatus.
Figure 15B:
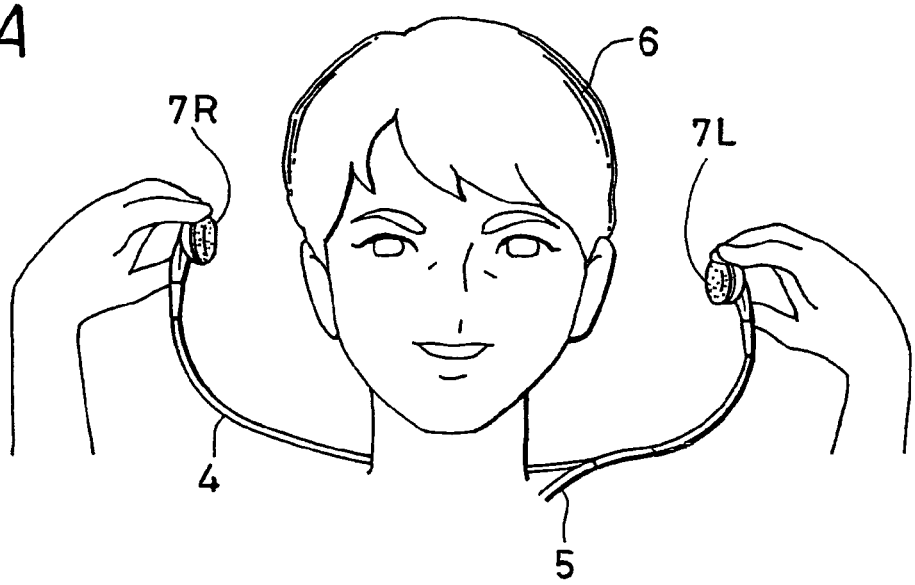
FIG. 15B is a front view showing an example in which inner ear headphones of a neck chain type are worn.

FIG. 2 shows an external view of headphones of the present invention. In FIG. 2, the same numerals are given to parts corresponding to those in FIG. 11. In headphones 10 of a neck chain type of the present invention, a bridge cord 4 of approximately 60 cm in length, for example, connecting a plug-attached cord 5 on the left side to a loudspeaker portion on the right side through a left unit 2L is passed through a cylindrical belt 11, and at the both ends thereof end members (stoppers) 12 made of resin, for example, that fix the bridge cord 4 and the cylindrical belt 11*a* are placed to form a strap portion 11. Further, the plug-attached cord 5 connects the left unit 2L and a destination jack of a portable audio apparatus or the like directly or through a remote control portion not shown in the figure, for example. Numerals 3, 3 are ear-hook portions which hold the left and right units 2L, 2R by being hooked on the left and right auricles of a user, respectively.

As the middle part of the bridge cord 4, namely as a cylindrical belt 11*a* provided at the part to be hooked on the neck, what is called Woolly Nylon® processed using the thermal plasticity of nylon to obtain an appearance and feel of wool as well as elasticity is used and is woven into the shape of a cylinder with a hole provided in the center, and both ends of the cylindrical belt 11*a* are fixed to the bridge cord 4 using stoppers 12 described later on.

Since this cylindrical belt 11*a* is a part which is in contact with the neck when the headphones 10 are hung on the shoulders, the length thereof only needs to be such a length as half around the neck, for example, 25 cm. Further, it is preferable that the material for this cylindrical band 11*a* has appropriate resilience which enables a user to feel comfortable when wearing the cylindrical band 11*a* in close contact with his/her neck, and does not impair the quality with respect to the overall product in appearance; and the material is not confined to the above-described Wooly Nylon® as long as it satisfies the above conditions. In addition, by selecting the material for this cylindrical belt 11*a* and the way it is woven, anti-slip effectiveness while the headphones are hung on the shoulders can be obtained.

Figure 3B:
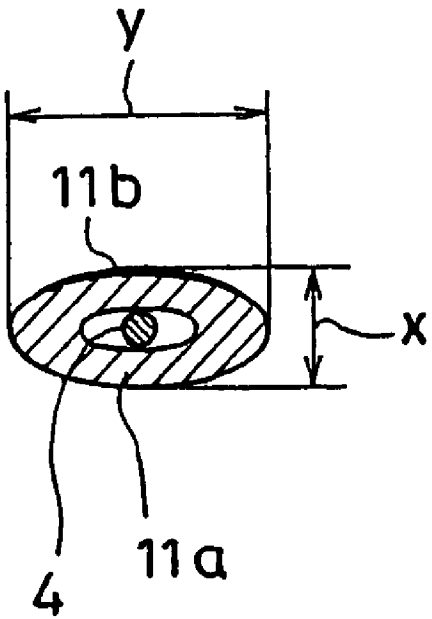
FIG. 3B is a cross-sectional view shown by B-B line.
Figure 3A:
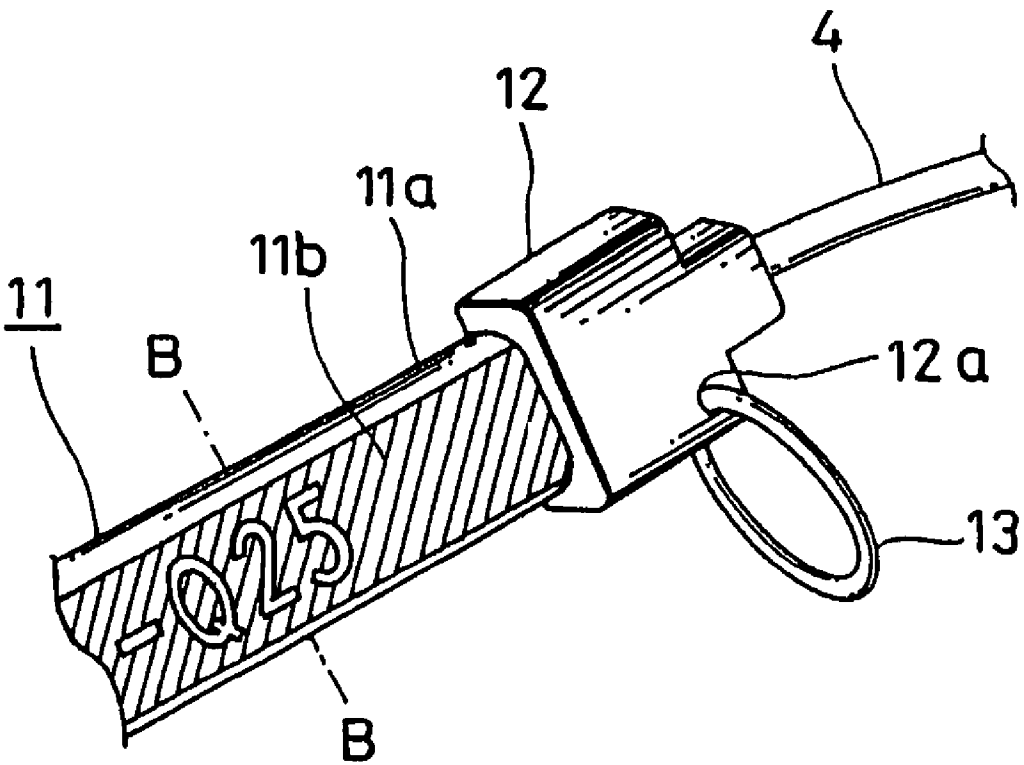
FIG. 3A is an enlarged view showing the relevant parts of FIG. 1.

FIG. 3A is an enlarged view of the relevant part of the headphones 10 of FIG. 2, which is surrounded by the dotted line a, and shows the state in which the cylindrical belt 11*a* and the bridge cord 4 are fixed by a stopper 12. This cylindrical belt 11*a* is provided with a printed portion 11*b* where decoration, dyeing or the like has been executed using as a printing ink, for example, a two-liquid reaction type polyurethane resin which is strong in adhesive force and excellent in coating properties; in this example, the symbol [-Q25] is printed in outline characters. Polyurethane resin printing ink preserves color well, and is superior in pliability, so that anti-slip effectiveness while hung on the neck can be expected. Also, one side or both the front and back sides of this printed portion 11*b* may be printed if necessary, such as by embossing the back side which is in contact with the neck, while providing the desired fashion-seeking design on the front side, for example.

Printing ink used for the above-described printed portion 11*b* of the cylindrical belt 11*a* is not limited to the above material as long as it is well covered, pliable and flexible when the cylindrical belt 11*a* is bent or the like.

As described above, fashionableness can be improved by providing decoration, dyeing and the like on the strap portion 11. Further, advertisements for enterprises, products and the like can be printed to be used for publicity, for example.

A B-B line cross-sectional view of the cylindrical belt 11*a* of FIG. 3A is shown in FIG. 3B. Since the cylindrical belt 11*a* is hung on the neck and also is provided with the above-described print, it is preferable that the cross-section thereof be somewhat flat shape such as an approximately oval shape or elongated oval shape, for example, approximately 3 mm in the minor axis direction x and approximately 7.5 mm in the major axis direction y in the figure, so as to enlarge the area touching the neck.

Accordingly, the area touching the neck is enlarged so as not to easily slip and weight which a user feels on his/her neck is also reduced to some extent; and further, the area of the printed portion 11*b* to be shown when hung on his/her neck and seen from behind the user, can be enlarged as described later on. Further, if the flat rate of the cylindrical belt 11*a* is high to some extent, the cylindrical belt 11*a* becomes closer to a belt-shape, which improves outer appearance thereof, so that a sense of beauty will be aroused.

Further, as shown in FIG. 3A, the stopper 12 has a structure in which accessories or the like can be attached; in this example, a hole 12*a* is provided to pass a ring-shaped attachment holder 13, so that fashionableness can be improved by providing the attachment holder 13 in the hole 12*a* of the stopper 12 and then attaching an optional accompaniment such as favorite accessories or small items to this attachment holder 13. As this attachment holder 13, other shapes desired by each user than the ring shape can also be attached. In this embodiment, when accessories or the like are attached to the strap portion 11, those are attached to the stopper 12; however, it should be noted that the method and structure to attach accessories or the like to the strap portion 11 are not limited to the method of this example in which the hole 12*a* is made in the stopper portion 12 and then the attachment holder 13 is provided.

Thus, the bridge cord 4 which has not usually been decorative can be improved in fashionableness by printing, dyeing, decorating the strap portion 11 such as the cylindrical portion 11*a*, and providing the stopper 12 so that accessories or small items can be attached thereto.

Figure 4A:
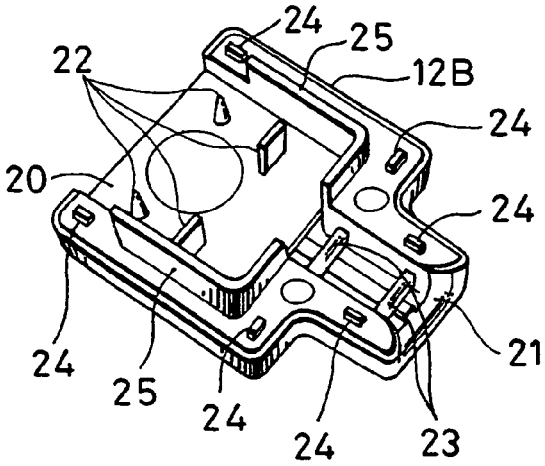
FIG. 4A is an external perspective view of a lower stopper member.
Figure 4B:
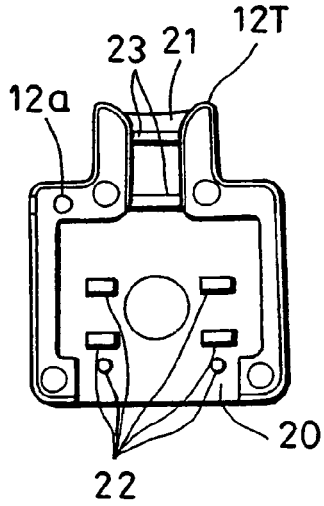
FIG. 4B is a top view of an upper stopper member.

Exploded views of the stopper 12 are shown in FIGS. 4A and 4B. FIG. 4A is a perspective view of a lower stopper member, and FIG. 4B is a top view of an upper stopper member. The stopper 12 is constructed in such a manner that projections and cavities provided in each of the lower stopper member 12B and the upper stopper member 12T are engaged with each other.

As shown in FIG. 4A, on the lower stopper member 12B are provided upright catching prevention boards 25, 25 so as not to catch the cylindrical belt 11*a* in the wrong manner when the upper stopper member 12T is engaged with the lower stopper member 12B; and in a hollow shape 20 inside the frame surrounded by the catching prevention boards 25, 25 are provided cylindrical belt fixing protrusions 22, 22, 22, 22 to fix the cylindrical belt 11*a*. With such a structure, simple and easy assembly can be performed. Further, regarding the upper stopper member 12T, a hollow shape 20 is also provided to engage with the catching prevention boards 25, 25 provided on the lower stopper member 12B. Further, on the lower stopper member 12B are provided cylindrical belt fixing protrusions 22, 22, 22, 22, 22, 22 to fix the cylindrical belt 11*a*.

As shown in FIG. 4B, in the upper stopper member 12T is provided a hole 12*a* for an attachment holder 13 to attach accessories or the like; it should be noted that the position of the hole is not limited to that in FIG. 4B. For example, the hole may be made through the upper and lower stopper members 12T, 12B, and if necessary, a hole for an attachment holder 13 may be provided in each of the two stoppers 12, 12 which fix both ends of the cylindrical belt 11*a*.

Figure 5A:
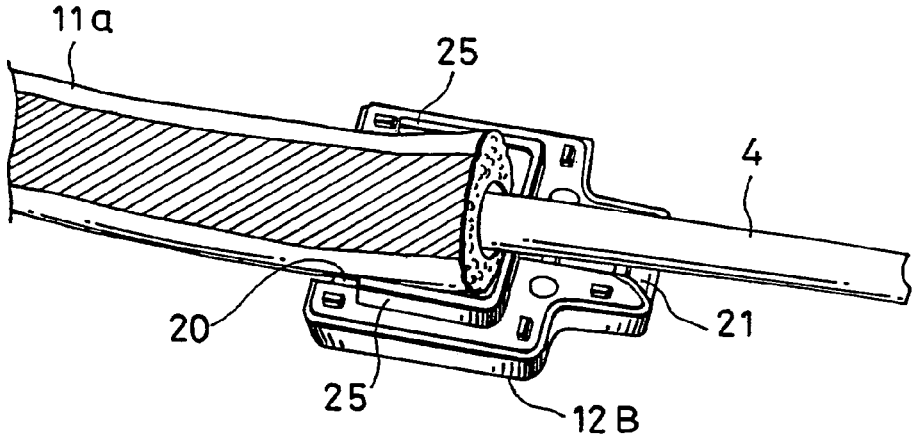
FIG. 5A is an external perspective view showing a state in which a bridge cord and a cylindrical belt have been fitted onto a lower stopper member.
Figure 5B:
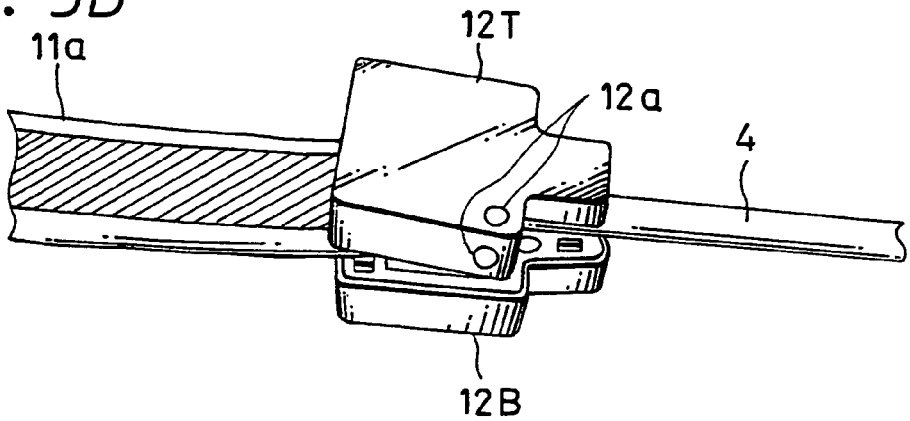
FIG. 5B is an external perspective view showing a state in which an upper stopper member is being fitted onto the lower stopper member of FIG. 5A.

Further, cord-fixing ribs 23, 23, 23, 23 are provided perpendicularly to the direction of the cord inserted in each of U-shaped grooves 21 of the lower stopper member 12B and the upper stopper member 12T, where the cord passes; and as shown in FIGS. 5A and 5B, those cord-fixing ribs have the function of fixing the bridge cord 4 by pressing the bridge cord 4 from above and below when the lower stopper member 12B and the upper stopper member 12T are engaged with each other. When ultrasonic deposition is executed between the lower stopper member 12B and the upper stopper member 12T, the resin-coated bridge cord 4 is deposited on the cord-fixing ribs 23 provided in the U-shaped grooves 21, 21 where this cord part passes, and also the cylindrical belt 11*a* shaped like a cylinder is deposited on the cylindrical belt fixing protrusions 22, 22, 22, 22, 22, 22.

Further, curved portions with a predetermined curvature radius R are provided at the entrances of the U-shaped grooves 21 of the lower stopper member 12B and the upper stopper member 12T as shown in FIGS. 4A and 4B, and R of the curved portions at the entrances is decided according to the material, thickness of the diameter and the like of the cord.

FIG. 5A is an external view showing the state in which a bridge cord and a strap have been fitted onto a lower stopper member, and FIG. 5B is an external view showing the state in which the lower stopper member of FIG. 5A and an upper stopper member are being fitted together. As shown in FIG. 5A, one end of the cylindrical belt 11*a* with the bridge cord 4 passing through a hole in the center thereof is fitted into the hollow shape 20 of the lower stopper member 12B, and the bridge cord 4 is fitted into a U-shaped groove 21. Next, as shown in FIG. 5B, the above-described lower stopper member 12B is covered with the upper stopper member 12T, and ultrasonic waves are applied to the upper and lower stopper members 12T, 12B with the both fitted together. Then, deposition fixing protrusions 24, 24, 24, 24, 24, 24 of the lower stopper member 12B are melted to be deposited in the corresponding parts of the upper stopper member 12T, so that the upper and lower stopper members 12T, 12B are joined together to be fixed along with the cylindrical belt 11*a* and the bridge cord 4.

In this example, ultrasonic deposition, which generates few burrs and does not require a solvent such as adhesive, has been employed as a deposition method; however, with respect to fixing of the bridge cord 4 and the cylindrical belt 11*a* to the stopper 12, the upper and lower stopper members 12T, 12B may be fastened together with screws or fixed together by adhesive, depending upon the materials thereof.

In headphones, coating of a cord is approximately 0.7 to 1 mm in thickness to maintain the flexible durability of the cord. The thicker the coating becomes, the greater the minimum radius when a cord is bent becomes to improve flexible durability, so that the minimum radius is decided after considering the texture and the like on condition that the cord is not too heavy and remains flexible. Therefore, if the cylindrical belt 11*a* is attached to a peripheral part of the bridge cord 4 described above, there is a possibility that the middle part of the bridge cord 4, namely the cylindrical belt 11*a* might become too thick and flexibility might be lost depending upon the selection of the bridge cord 4 and the selection of the cylindrical belt 11*a*, resulting in the limitation in the selection of the bridge cord 4 and the selection of the cylindrical belt 11*a*.

Figure 6A:
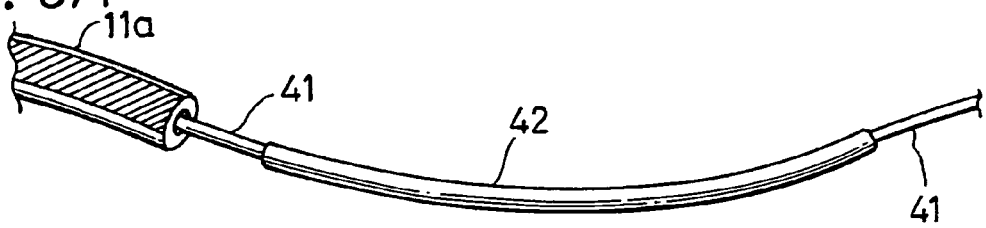
FIG. 6A is an external perspective view showing a state in which a narrow cord is covered with cord clothing.
Figure 6B:
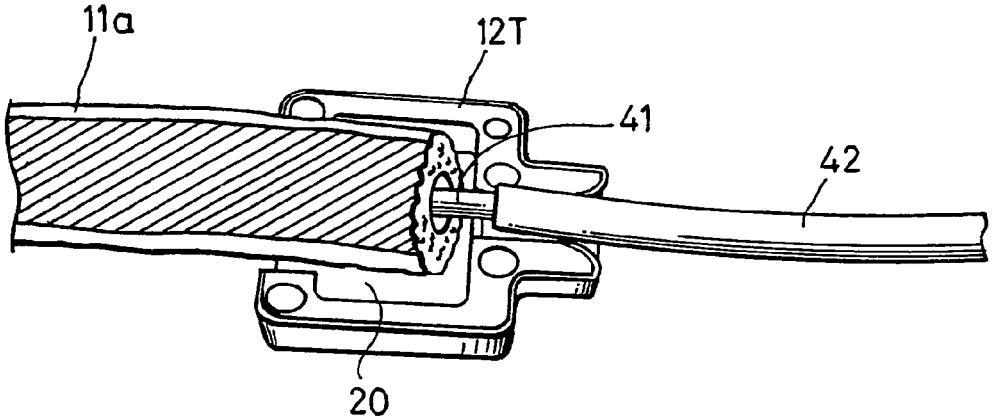
FIG. 6B is an external perspective view showing a state in which the narrow cord and cord clothing of FIG. 6A are fitted onto the upper stopper member.

Accordingly, as shown in FIG. 6A, after a thinly coated narrow cord (or only a wire rod) 41 is covered with the cylindrical belt 11*a*, cord coating 42 with a wider diameter than that of the narrow cord 41 covers the vicinity of each end of the cylindrical belt 11*a*; and as shown in FIG. 6B, the cord coating 42 is fitted into the U-shaped grooves 21 of the upper stopper member 12T and the like in the stopper 12 in the same manner as described above. The part where the bridge cord 41 is covered with the cord coating 42 is in such a state of double coating.

With the above structure, the middle part of the narrow bridge cord 41 that is covered with the cylindrical belt 11*a* to be thin and flexible, thus improving the way a user feels when wearing that on his/her neck, and also the flexible durability of the cord can be maintained by the cord coating 42 being positioned at the entrance of the U-shaped grooves 21 of the stopper 12.

Figure 7:
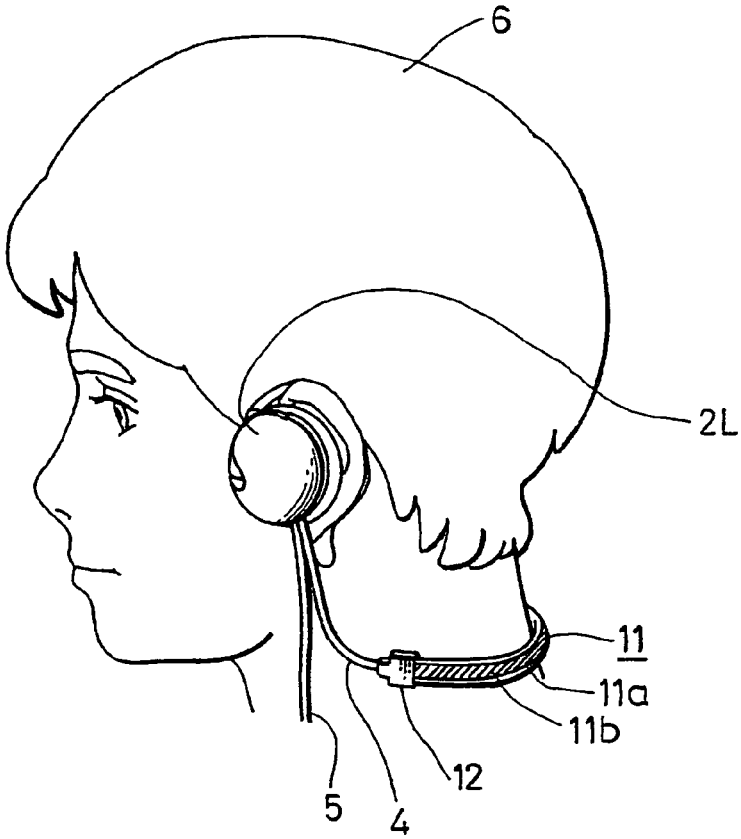
FIG. 7 is a left side view showing an example in which headphones of the present invention are worn.
Figure 8:
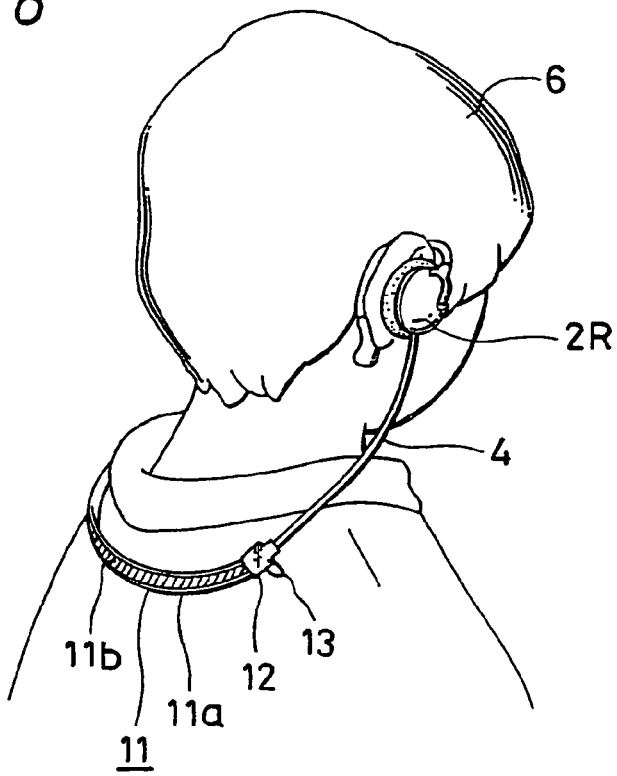
FIG. 8 is a right rear view showing an example in which headphones of the present invention are worn.

FIGS. 7 and 8 are views in which a user 6 wearing the headphones 10 of this embodiment is seen from the left side and is seen from the right side from behind, respectively. As shown in those FIGS. 7 and 8, the printed portion 11*b* of the cylindrical belt 11*a* passed behind the neck while the user 6 is wearing the headphones can be seen well from behind the user 6. In other words, a decorated or dyed part of the printed portion 11*b* can easily be seen by other people.

Figure 9:
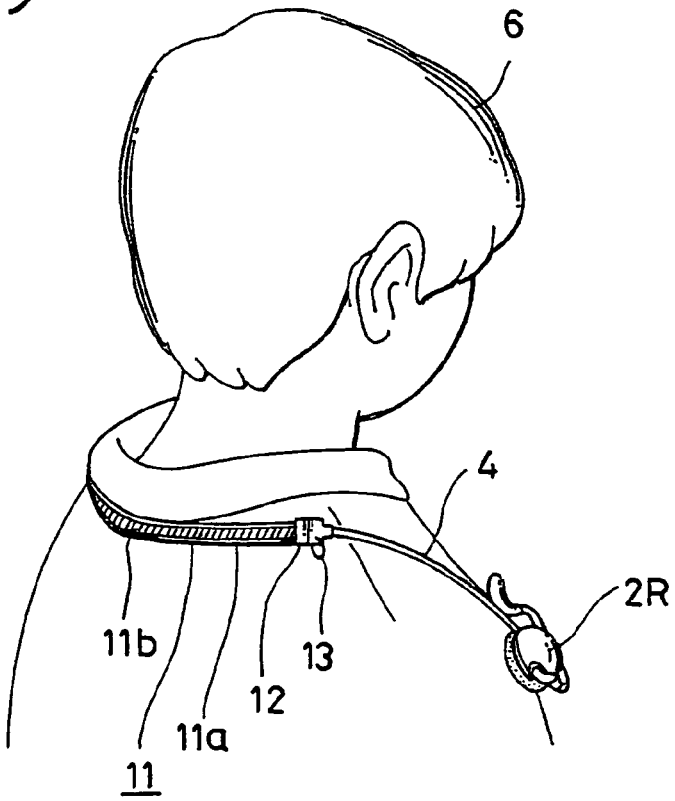
FIG. 9 is a right rear view showing a state in which headphones of the present invention are hung on the shoulders.
Figure 10:
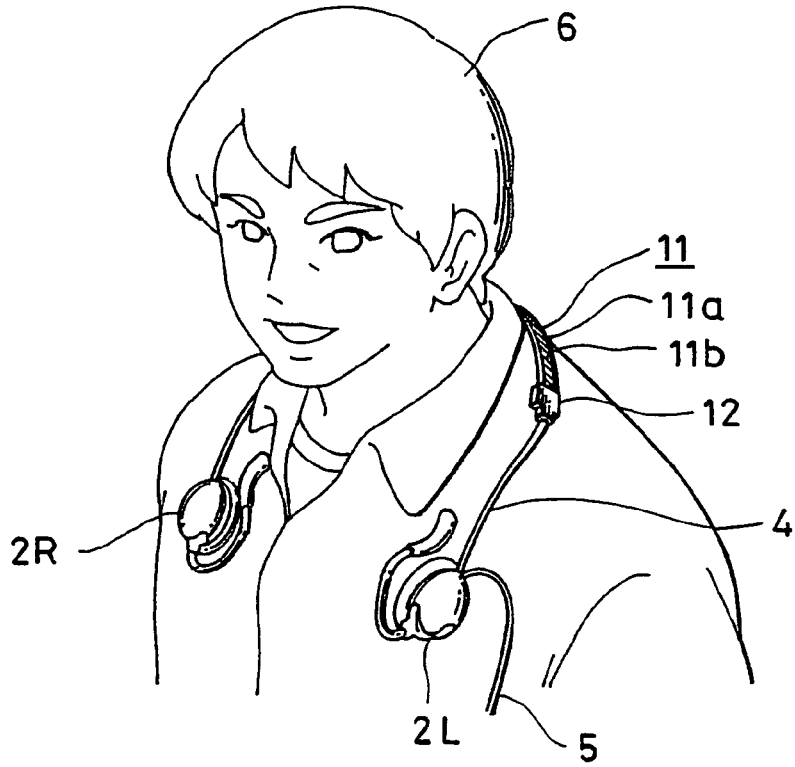
FIG. 10 is a diagonal left front view showing a state in which headphones of the present invention are hung on the shoulders.

FIGS. 9 and 10 are views in which the user 6 with the headphones 10 of this embodiment hung on his/her shoulders is seen from the right side from behind and is seen from the left diagonally in front, respectively. In this state, the printed portion 11*b* of the cylindrical belt 11*a* can also be seen from behind the user 6 well similarly to FIGS. 7 and 8 in which the headphones 10 are worn. Further, on this occasion, the left and right units 2L and 2R of the headphones 10 can be hung loosely on both shoulders with the bridge cord 4 passed through the cylindrical belt 11*a* hung on the neck, serving as a strap. Moreover, the cylindrical belt 11*a* itself functions as an slip stopper or printed portion 11*b* provided with a print or decoration of the cylindrical belt 11*a* functions as a slip stopper, so that the headphones 10 will not slip off and usability will be improved. In addition, the fact that the headphones 10 are unlikely to slip off enables the user 6 to walk in town with the headphones 10 hung on his/her shoulders without feeling uneasy about slipping off, and also enables people to see the printed portion 11*b* of the cylindrical belt 11*a*, thereby improving usability and fashionableness.

In this embodiment, stoppers are provided at both ends of a cylindrical belt to be fixed to a bridge cord; there are conceivable other structures such as, for example, a strap portion and a bridge cord can be integrally formed without providing stoppers; after the bridge cord has been passed through the cylindrical belt, slipping caused between a bridge cord and a cylindrical belt is eliminated by means of some method or other or by means of the selection of materials to make stoppers unnecessary; and a hole or the like is provided at an end of a strap portion without providing stoppers, to which accessories can be attached directly.

Further, the present invention can be applied to apparatuses having left and right driver units connected by a cord passed behind the neck; therefore, the present invention can be applied to what is called a headset in which headphones and a microphone are integrally formed, to headphones without a plug-attached cord 5 in which a radio communication with a portable audio apparatus or the like is performed, and so forth.

It should be noted that the present invention is not limited to the above-described embodiments but various other structures can be adopted without departing from the gist of the present invention.

DESCRIPTION OF REFERENCE NUMERALS

2L, 2R . . . UNIT
4, 41 . . . BRIDGE CORD
10 . . . HEADPHONE
11*a* . . . CYLINDRICAL BELT
11*b* . . . PRINTED PORTION
12 . . . STOPPER
12*a* . . . HOLE
12T . . . UPPER STOPPER MEMBER
12B . . . LOWER STOPPER MEMBER
13 . . . ATTACHMENT HOLDER
22 . . . CYLINDRICAL BELT FIXING PROTRUSION
23 . . . CORD-FIXING RIB
25 . . . CATCHING PREVENTION BOARD
42 . . . CORD COATING

What is claimed is:

1. Headphones in which left and right driver units are connected by a cord passed behind a neck, comprising:

a belt-shaped strap portion in which a first part of the cord is inserted into a belt, said belt having a first end and a second end, the first part of the cord with the belt-shaped strap surrounding being thicker than a second part and a third part of the cord, said second and third parts extending out from the belt-shaped portion, and the belt having a first end member provided at said first end and a second end member provided at said second end of said belt, respectively, and connected to said cord and said belt, said end members separate from said left and right drivers;

wherein the second part of the cord connects the left driver unit and the first end member, the third part of the cord connects the right driver unit and the second end member, and left and right ear-hook portions that are attached directly to said left and right driver units respectively, the left and right ear-hook portions shaped to hold the left and right driver units on the left and right auricles of a user, respectively, when hooked thereon, wherein the thickened belt-shaped strap portion is a slip stopper to inhibit the headphones from slipping off a user when hung around the user's neck, and the first part reduces the weight which the user feels on the user's neck.

2. The headphones according to claim 1, wherein said left ear-hook portion and said cord are attached approximately opposed position around said left driver unit, and said right ear-hook portion and said cord are attached approximately opposed position around said right driver unit.

3. The headphones according to claim 2, wherein said belt-shaped strap portion in which the first part of said cord is inserted into a cylindrical belt and end members fixing said cord and said cylindrical belt are provided at both ends of the cylindrical belt, wherein each end member includes separate upper and lower members.

4. The headphones according to claim 3, wherein said end member includes protrusions to fix said cord and said cylindrical belt are provided inside at least either said end members.

* * * * *